United States Patent [19]

Park

[11] Patent Number: 4,797,023

[45] Date of Patent: Jan. 10, 1989

[54] MINE ROOF SUPPORTS

[75] Inventor: Roy Park, Wigan, England

[73] Assignee: Gullick Dobson Limited, Lancashire, England

[21] Appl. No.: 51,784

[22] Filed: May 20, 1987

[30] Foreign Application Priority Data

Jun. 4, 1986 [GB] United Kingdom ..... 8613514

[51] Int. Cl.[4] ..... E21D 15/44

[52] U.S. Cl. ..... 405/291; 405/296; 405/299

[58] Field of Search ..... 405/291, 293, 295, 296, 405/297, 299; 299/33

[56] References Cited

U.S. PATENT DOCUMENTS

| | | | |
|---|---|---|---|
| 3,848,928 | 11/1974 | Nakajima | 299/33 |
| 3,925,995 | 12/1975 | Harmsma et al. | 405/299 |
| 4,056,941 | 11/1977 | Watermann | 405/296 |
| 4,121,426 | 10/1978 | Heyer | 405/296 |

FOREIGN PATENT DOCUMENTS

| | | |
|---|---|---|
| 0181799 | 10/1985 | European Pat. Off. . |
| 1170156 | 11/1969 | United Kingdom . |
| 1358541 | 7/1974 | United Kingdom . |
| 1414257 | 11/1975 | United Kingdom . |
| 1505373 | 3/1978 | United Kingdom . |
| 2032496A | 4/1980 | United Kingdom . |

*Primary Examiner*—David H. Corbin

*Attorney, Agent, or Firm*—Armstrong, Nikaido, Marmelstein & Kubovcik

[57] ABSTRACT

A mine roof support has a roof engaging canopy 23, a floor engaging base 12, and a hydraulic jack 24 acting between the canopy and the base for urging the canopy and the base apart. The hydraulic jack 24 is provided with at least two different locations, movement of the jack means 24 from one location to another location bringing about an alteration in the distance between the canopy and the base. The invention makes it possible to provide a hydraulic jack having a first working position in which the hydraulic jack is arranged in the optimum position to support a mine roof, and a second stowing position for transportation purposes.

6 Claims, 3 Drawing Sheets

MINE ROOF SUPPORTS

The invention relates to mine roof supports of the type having a roof engaging canopy and a floor engaging base interconnected by a pivotal linkage, there being hydraulic jack means acting between the base and the canopy for urging the canopy against the roof of a mine working.

With such supports, the path followed by the canopy, as it moves relative to the base under the influence of the hydraulic jack means, is controlled by the pivotal linkage. The canopy has a range of working positions, in which the hydraulic jack means is extended to a greater or lesser extent, and also has a transportation position in which the canopy and base are positioned as close together as possible, with the hydraulic jack means fully retracted. In this configuration the pivotal linkage generally projects substantially from the rear of the support.

The hydraulic jack means generally comprises at least one hydraulic ram arranged to act along a line which is inclined to the vertical. One reason for the inclination of the ram is to try to reduce the amount of space taken up by the ram when the canopy is in its transportation position. However the inclined position means that in operation the ram can be subjected to undesirable lateral loading.

We have now designed a mine roof support in which the hydraulic jack means is less susceptible to undesirable lateral loading and also has other advantages over prior art supports.

Accordingly the invention provides a mine roof support having a roof engaging canopy, a floor engaging base, and hydraulic jack means acting between the canopy and the base for urging the canopy and the base apart, said hydraulic jack means being provided with at least two different locations on the canopy and/or base, movement of the jack means from one location to another location, enabling the distance between the canopy and the base to be altered.

Movement of the hydraulic jack means from one location to another location may alter the angular attitude of the jack means.

Preferably the hydraulic jack means has two alternative locations on the floor engaging base.

Alternatively however, the hydraulic jack means may have two alternative locations on the roof engaging canopy.

The hydraulic jack means may have a first working position in which the hydraulic jack means is arranged in the optimum position to support a mine roof, and a second, stowing position for transportation purposes.

In the working position the hydraulic jack means may be substantially vertical.

Preferably the hydraulic jack means comprises at least two hydraulic jacks.

By providing two hydraulic jacks, one jack of the pair may be used to support the roof engaging canopy while the other jack of the pair is moved between its working and stowing positions.

By way of example, a specific embodiment of the invention will now be described, with reference to the accompanying drawings, in which.

Figure 1:
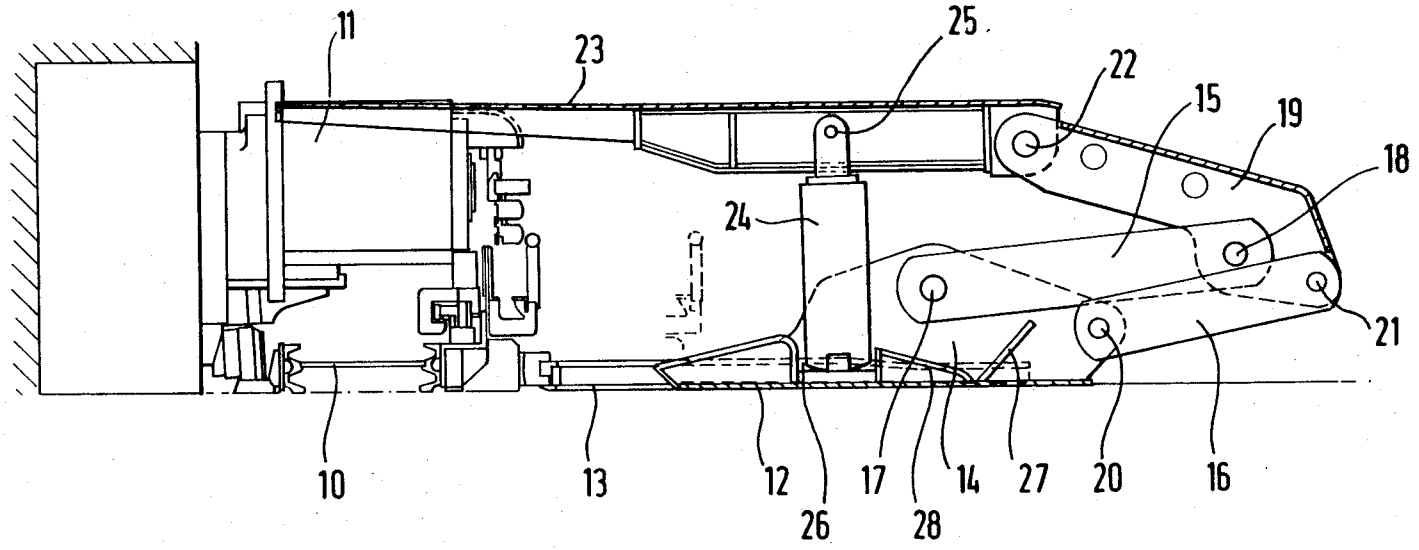
FIG. 1 is a side view of an embodiment of mine roof support according to the invention, in a working position.

The mine roof support shown in the Figures is intended for use in a conventional mine working adjacent to a mineral conveyor 10 and mineral cutting machine 11. The mine roof support has a catamaran-type floor engaging base 12 connected to the conveyor 10 in a conventional manner by a hydraulic ram 13 positioned between the skids of the catamaran-type base.

The base 12 has upwardly extending side flanges 14 and connected to each flange is a pair of links 15 and 16. Each link 15 is pivotally connected at 17 to the associated flange and is also pivotally connected at 18 to a shield member 19. Each link 16 is pivotally connected to the associated flange at 20 and is also pivotally connected at 21 to the shield member 19.

The shield member 19 is in turn pivotally connected at 22 to a roof engaging canopy 23. The links 15 and 16 and the shield 19, together comprise a so-called Lemniscate linkage which controls the longitudinal movement of the roof engaging canopy 23 relative to the floor engaging base 12.

Movement of the canopy 23 is brought about by hydraulic jack means in the form of a pair of hydraulic jacks 24,24'. In the position shown in FIG. 1, these hydraulic jacks are arranged substantially vertically, the upper end of each jack being pivotally connected at 25 to the roof engaging canopy 23, and the lower end of each jack being retained in a location recess 26 in the base 12.

In this position the jacks are placed to provide the optimum support for a mine roof, with minimal lateral loading of the jacks. However this vertical position also means that the extent to which the support can be retracted is limited, and FIG. 1 shows the minimum closed height with the jacks in the vertical position.

However this embodiment of mine roof support has an alternative location position for the lower end of each jack 24,24' provided by a plate 27 provided on the base 12 and extending between the flanges 14.

Figure 2:
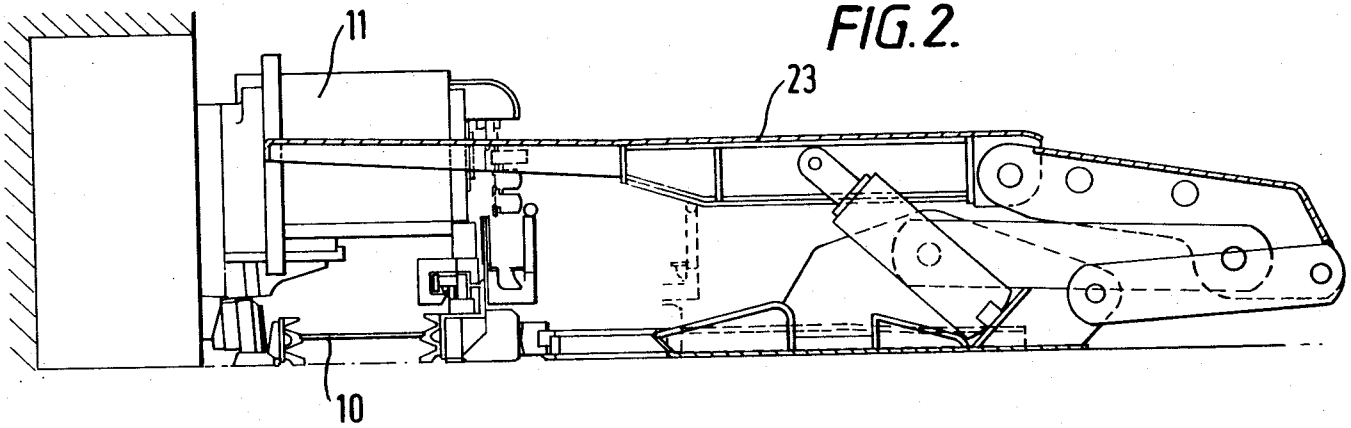
FIG. 2 is a side view of the embodiment of support in the transportation position.
Figure 3:
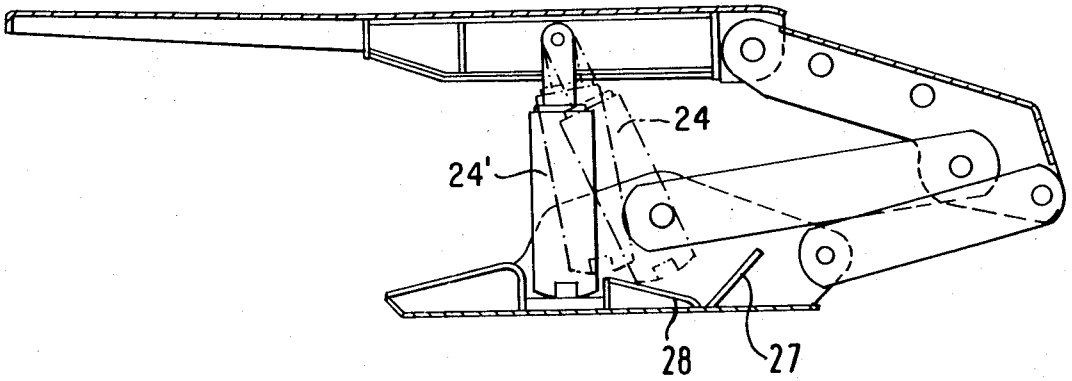
FIG. 3 is a side view illustrating a stage in the movement of the support between the positions shown in FIGS. 1 and 2.
Figure 4:
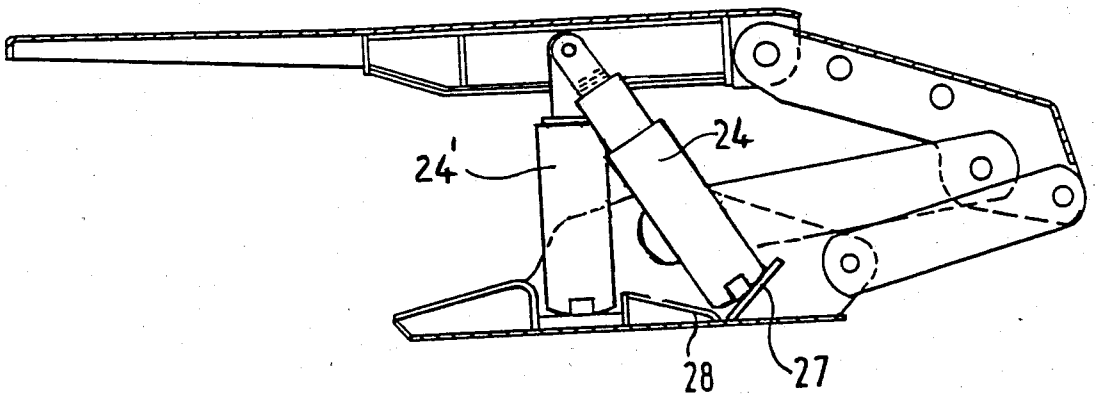
FIG. 4 is a side view illustrating one hydraulic jack in one position and another hydraulic jack in another position.

In order to collapse the support even further so that it will take up an even smaller amount of space for transportation, the hydraulic jacks are extended to at least the length shown in FIG. 3. The quick release means that retain the lower ends of the jacks in the recesses 26 are then removed. While the canopy 23 remains supported by one of the jacks 24', the other jack 24 is retracted until it is free of its recess 26. It can then be pivoted backward, as shown in dotted lines in FIG. 3, until its lower end is over a ramp plate 28 which leads downwardly towards the plate 27. The inclined leg is then extended again which will cause its lower end to slide over the ramp plate 28 and engage against the plate 27 as shown in FIG. 4. In this inclined position the leg can still provide sufficient support to maintain the unloaded canopy 23 in the position shown in FIG. 4 while the other jack 24' is moved in a similar manner. Once the lower ends of both jacks are in engagement with the plate 27 they are pinned to the plate by quick release pins and are fully retracted to draw the canopy 23 down into its lowermost position as shown in FIG. 2, for transportation to a new location.

When it is desired to return the support to its working position, the quick release pins maintaining the jacks in contact with the plate 27 are removed and one of the jacks is extended, keeping the other jack retracted. Extension of the first jack raises the canopy and this draws the retracted jack into the vertical position. The retracted jack can then be extended to engage its lower end in the associated location recess 26. It can then support the canopy while the other leg is retracted to draw it into the vertical position. It can then be extended to engage in its location recess and the quick release means can be engaged.

This two position arrangement of the hydraulic rams has a number of advantages.

Because the hydraulic jacks remain substantially vertical during their movement through their working range, the load rating of the mine roof support is constant throughout its working range. With a known support having two hydraulic jacks, the rating varies with height and the support and hydraulic jacks have to be designed to a higher rating than the support and jacks of this embodiment.

With known hydraulic roof supports where the hydraulic jacks are permanently inclined to the vertical, the construction of the pivotal linkage projects rearwardly to a greater extent than in this embodiment. Thus for any given spacing between the base and canopy the support forming the subject of this embodiment has a shorter overall length than similar known supports, thus further easing further transportation problems and reducing the extent to which the linkage projects into the waste areas of the mine workings.

Because the hydraulic jacks are placed in the optimum position to support load, the forces to which the pivotal linkage is subjected are substantially reduced, possibly by as much as 60 to 70%. Thus the linkage can be manufactured from less substantial material bringing about cost and weight savings.

The embodiment according to the invention also has advantages from the point of view of long term reliability. Because lateral forces on the hydraulic jacks are substantially removed, and the hydraulic jacks do not pivot significantly during their working, load bearing movements, the hydraulic jacks are less prone to failure. For example there are minimal frictional forces between the lower ends of the jacks and the location recesses 26.

When hydraulic jacks are used which are permanently inclined, the angle of inclination obviously changes as the support is lowered. Lowering of the support can thus be obstructed by mine debris trapped between the base of the support and the downwardly pivoting hydraulic jacks. Since the hydraulic jacks of this embodiment do not pivot significantly during their working range, this problem does not arise.

The canopy may be specially shaped to accommodate therein the inclined jack means or part therefor.

The links 16 may be joined together, for example by a further shield member.

The hydraulic jack means may be arranged to bear working loads even in the inclined position.

A miners walkway may be provided in front of the hydraulic jack means.

Instead of two pairs of links, three links may be used, for example one central link and a pair of side links.

The invention is not restricted to the details of the foregoing embodiment.

I claim:

1. A mine roof support, comprising:

a mine floor engaging base having a front, a rear and a longitudinal axis extending from said front to said rear;

a mine roof engaging canopy;

linkage means for pivotally connecting said base and said canopy;

hydraulic jack means for urging said canopy upwardly into load bearing contact with a mine roof, said hydraulic jack means having upper and lower ends;

upper pivotal connection means for permanently pivotally connecting said upper end of said hydraulic jack means to said canopy;

first and second jack receiving means disposed in said base for receiving said lower end of said hydraulic jack means, said second jack receiving means being non-vertically aligned with said upper pivotal connection, said first jack receiving means being spaced from said second jack receiving means in the direction of said longitudinal axis and spaced from said upper pivotal connection by a distance which is shorter than the distance between said upper pivotal connection and said second jack receiving means, said hydraulic jack means being pivotally movable from a first mine roof load bearing position in which said second end is received by said first jack receiving means and said linkage means is in a substantially open configuration to a second transportation position in which said second end is received by said second jack receiving means and said linkage means is in a substantially closed configuration, the space occupied by said mine roof support in said second position being reduced substantially with respect to the space occupied by said mine roof support in said first position, whereby transportation of said support is facilitated.

2. A mine roof support as claimed in claim 1, in which, in said first mine roof load bearing position, said hydraulic jack means is substantially vertical.

3. A mine roof support as claimed in claim 1, in which said hydraulic jack means comprises at least two hydraulic jacks.

4. A mine roof support as claimed in claim 1, and further including guide means for guiding said lower end of said hydraulic jack means towards said second jack receiving means.

5. A mine roof support as claimed in claim 4, wherein said guide means comprises a ramp plate.

6. A method of operating a mine roof support comprising a mine floor engaging base having a front, a rear and a longitudinal axis extending from said front to said rear, a mine roof engaging canopy, a linkage means pivotally connecting said base and said canopy, first and second hydraulic jack means for urging said canopy upwardly into load bearing contact with a mine roof, said first and second hydraulic jack means having respective upper and lower ends, first and second upper pivotal connection means for permanently pivotally connecting said upper ends of said first and second hydraulic jack means to said canopy, first and second jack receiving means disposed in said base for receiving said lower ends of said first and second hydraulic jack means, said second jack receiving means being non-vertically aligned with said upper pivotal connections, said first jack receiving means being spaced from said second jack receiving means in the direction of said longitudinal axis and spaced from said upper pivotal connection by a distance which is shorter than the distance between said upper pivotal connection and said second jack receiving means, said first and second jack means being pivotally movable from a first mine roof load bearing position in which said second ends are received by respective first jack receiving means and said linkage means is in a substantially open configuration to a second transportation position in which said second ends are received by respective second jack receiving means and said linkage means is in a substantially closed configuration, said method comprising:

retracting said first hydraulic jack means away from said first jack receiving means while said second hydraulic jack means is in said first position bearing the load of said canopypivotally moving said first hydraulic jack means towards said second jack receiving means and extending said first hydraulic jack means into engagement with said second jack receiving means to bear the load of said canopy;

retracting said second hydraulic jack means from said first jack receiving means while said first hydraulic jack means is bearing the load of said canopy;

pivotally moving said second hydraulic jack means towards said respective second jack receiving means and extending said second hydraulic jack means into engagement with said second jack receiving means;

retracting said first and second hydraulic jack means into said second position to move said linkage means from said substantially open configuration to said substantially closed configuration, the space occupied by said mine roof support in said second position being reduced substantially with respect to the space occupied by said mine roof support in said first position, whereby transportation of said support is facilitated.

* * * * *